US005644925A

United States Patent [19]

Chaves

[11] Patent Number: 5,644,925

[45] Date of Patent: Jul. 8, 1997

[54] AIR CONDITIONING SYSTEM CONDENSING TRAP

[76] Inventor: Manuel J. Chaves, 276 Manning St., Hudson, Mass. 01749-1037

[21] Appl. No.: 674,765

[22] Filed: Jul. 2, 1996

[51] Int. Cl.[6] ..... F25D 21/14

[52] U.S. Cl. ..... 62/289; 62/272; 137/192

[58] Field of Search ..... 62/272, 285, 288, 62/289; 137/192

[56] References Cited

U.S. PATENT DOCUMENTS

| | | | |
|---|---|---|---|
| 2,048,137 | 7/1936 | Palmer | 62/176 |
| 3,232,029 | 2/1966 | Evans, Jr. | 55/71 |
| 3,635,246 | 1/1972 | Glickman | 137/608 |
| 3,725,964 | 4/1973 | Whitsett | 4/197 |
| 3,818,718 | 6/1974 | Freese | 62/272 |
| 3,905,203 | 9/1975 | Jacob | 62/272 |
| 4,484,451 | 11/1984 | Darm | 62/90 |
| 4,509,338 | 4/1985 | Gould | 62/288 |
| 4,671,076 | 6/1987 | Duren | 62/289 |
| 4,679,405 | 7/1987 | Mitchell et al. | 62/285 |

*Primary Examiner*—John M. Sollecito
*Attorney, Agent, or Firm*—Fish & Richardson P.C.

[57] ABSTRACT

A condensate trap for an air conditioning system includes a chamber having an upstream port coupled to the air conditioning system and a downstream port coupled to the external atmosphere, a sealing device disposed in the chamber, a lower seat member positioned in the chamber, and an upper seat member, disposed between the sealing device and upstream port. In response to a positive pressure at the upstream port, the sealing device contacts the lower seat member to prevent air from the air conditioning system from exiting to the external atmosphere. On the other hand, in response to a negative pressure at the upstream port, the sealing device contacts the upper seat member to form a seal which prevents the ingress of air from the external atmosphere into the air conditioning system. Moreover, in response to a predetermined amount of condensate accumulating in the chamber, the sealing device moves out of contact with the seat members to allow the fluid to drain from the downstream port of the chamber.

11 Claims, 3 Drawing Sheets

AIR CONDITIONING SYSTEM CONDENSING TRAP

BACKGROUND OF THE INVENTION

The invention relates to removing condensate from air conditioning systems.

Air conditioning systems generally include a blower which blows or draws air over a heat exchanger coil on which condensation accumulates and drips to a discharge pan positioned below the coil. The condensation (or condensate) which overflows from the pan is drained from the system through a discharge port on to the ground or into the sewer system.

Referring to FIG. 1A, an air conditioning system 10 includes a blower 11 positioned to draw external air through a filter 14 and push the air over a heat exchanger 12, thereby presenting positive pressure at the discharge port where the condensate is discharged. A system having the blower positioned with respect to the heat exchanger in this manner is known as a "blow-through" system. Condensate from the heat exchanger drips into a condensate pan 13 having a drain port 15 connected to a U-shaped condensate trap 16.

Referring to FIG. 1B, on the other hand, if the blower is positioned to draw air over the coil, the system is a "draw-through" system with a negative pressure present at the port where the condensate is discharged. With this arrangement, blower 11 is positioned to pull air through the heat exchanger.

A condensate trap 16 in the form of U-shaped piping is generally provided at the discharge port. In either configuration, the U-shaped trap 16 must be filled with water prior to starting up the system. The water in the trap forms a barrier between atmospheric pressure at the discharge port of the trap and the pressure level within the system, thereby preventing escape of conditioned air in the system of FIG. 1A or introducing outside air into the system of FIG. 1B. The trap also collects foreign material passed through the discharge pan from the system.

SUMMARY OF THE INVENTION

The invention features a condensate trap which prevents the transfer of air between an air conditioning system and the external atmosphere, while allowing trapped condensate and foreign material collected in the trap to be safely removed from the system.

In a general aspect of the invention, a condensate trap for an air conditioning system includes a chamber having an upstream port for coupling to the air conditioning system and a downstream port open to the external atmosphere, a sealing device disposed in the chamber, a lower seat member positioned in the chamber, and an upper seat member, disposed between the float and upstream port. In response to a positive pressure at the upstream port, the sealing device contacts the lower seat member to prevent air from the air conditioning system from exiting to the external atmosphere. On the other hand, in response to a negative pressure at the upstream port, the sealing device contacts the upper seat member to prevent the ingress of air from the external atmosphere into the air conditioning system. Moreover, in response to a predetermined amount of condensation fluid accumulating in the chamber, the sealing device moves out of contact with the seat members to allow the fluid to drain from the downstream port of the chamber.

In preferred embodiments, the invention may include one or more of the following features. The sealing device is a float, for example, a round and hollow ball. The chamber is formed as a cylindrical pipe and includes a groove formed within its inner surface. The upper seat member is an O-ring supported within the groove. The lower seat member has an O-ring which provides a sealing surface to the sealing device. The cylindrical pipe is formed of a transparent material to allow the installation or service technician to visually inspect and ensure that the condensate trap is properly operating.

With the invention, infiltration of air into and out of the system is minimized, thereby reducing pressure imbalances within the system. Preventing transfer of air between the air conditioning system and external atmosphere is achieved by the trap whether the system is used with a draw-through or blow-through system. For example, when used with a draw-through system, the trap prevents air from the external atmosphere (which may be polluted) from infiltrating the system. When used with a blow-through system, the trap prevents loss of air from the air conditioning system to the external atmosphere. In either case, the trap also prevents collected condensate or other foreign matter (e.g., sediment) from accumulating in the trap. The trap is configured to allow the condensate and foreign matter to drain from the system through the bottom of the trap. Thus, unlike conventional U-shaped traps, sediment which can clog the trap does not accumulate in the trap. Moreover, the trap isolates the air conditioning system from the external atmosphere, without requiring the use of fluid (e.g., collected condensate) which is required in conventional U-piping traps. Thus, in the present invention, there is no risk of damaging the trap due to freezing of the fluid in the trap.

The condensate trap is easily installed and it is easily removed from the system for maintenance or repair. The trap can also be directly substituted for a conventional U-piping trap without requiring any modification to the existing air conditioning or duct system.

Other features and advantages of the invention will become apparent from the following detailed description, and from the claims.

DESCRIPTION OF THE PREFERRED EMBODIMENTS

Figure 1A:
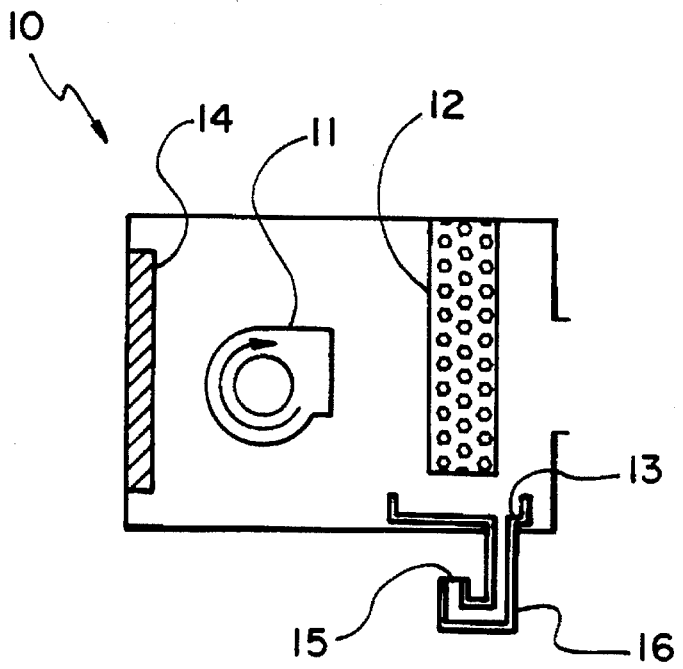
FIG. 1A is a schematic representation of a conventional blow-through type system.
Figure 1B:
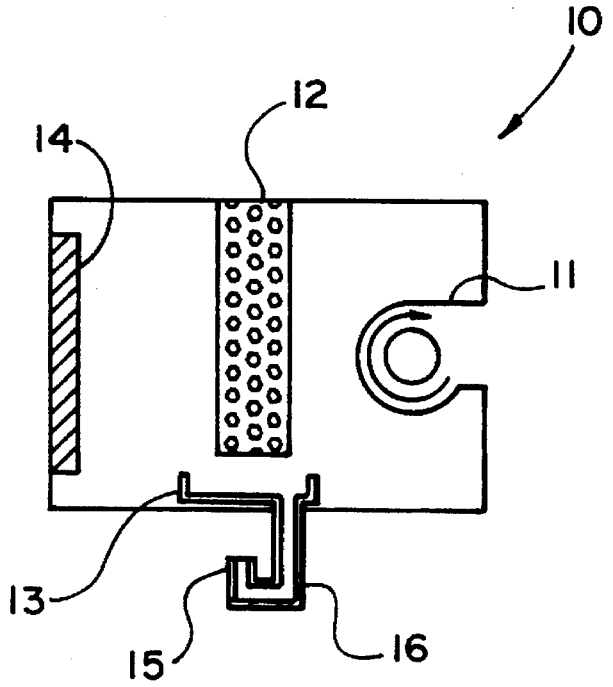
FIG. 1B is a schematic representation of a conventional draw-through type system.
Figure 2:
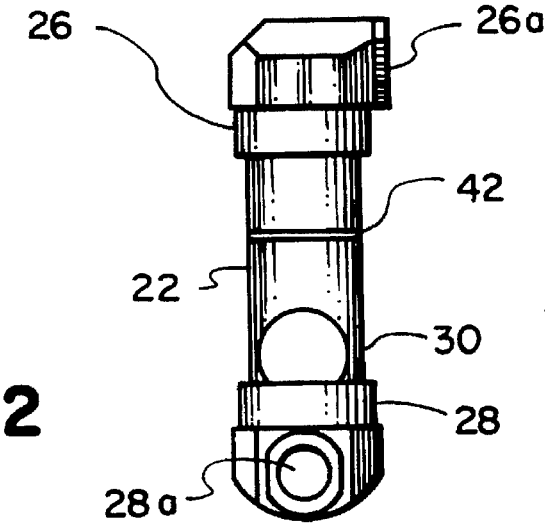
FIG. 2 is a perspective, exploded view of the condensate trap in accordance with the invention.
Figure 3:
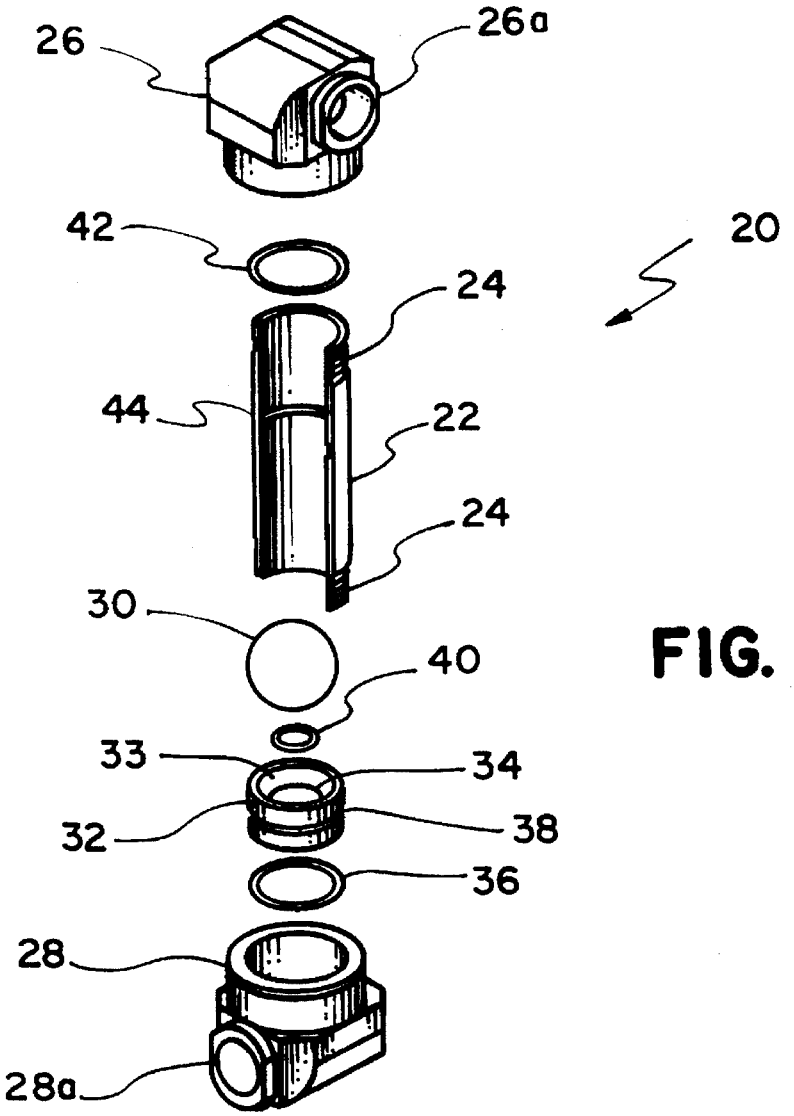
FIG. 3 is a side view of the condensate trap of FIG. 2.

Referring to FIGS. 2 and 3, a condensate trap 20 which may be substituted for the U-shaped traps 16 shown in FIGS. 1A and 1B is shown. Condensate trap 20 includes a transparent cylindrical tube 22 having a length of approximately six inches and an inner diameter of 1 ½ inches. Tube 22 is formed of PVC plastic and includes threads 24 at its ends for receiving adapting fixtures 26, 28 which connect the tube to the rest of the air conditioning system and the discharge piping, respectively. Fixtures 26, 28 includes inlet and outlet ports **26*a*, 28*a*, respectively, which extend at right angles to the axis of the tube. Fixtures 26, 28** are rotatable about the axis of the tube to facilitate connecting it to the piping of the air conditioning system and discharge piping.

A round hollow float 30 (e.g., a ping pong ball) having a diameter slightly less than the diameter of the tube is positioned to move freely within the tube. Under normal conditions, float 30 rests on a collar 32 positioned at the lower end of the tube near adapting fixture 28. Collar 32 includes a thru-hole 34 which is covered by the float at a seat surface 33. An O-ring 36 formed of neoprene rubber is positioned within a groove 38 extending around the periphery of the seat to form a seal between the inner wall of the tube and the collar. An O-ring 40 is positioned within thru-hole 34 to provide a seal between the surface of the float and the seat surface 33. The seat surface 33 of the bottom seat is slightly concave to facilitate drainage of condensate collected in the tube. However, it is important that surface 33 be shaped so as not to contact the float. Requiring the seal to be between the float and O-ring 40, ensures that condensate can collect below the float and allow it to become buoyant. An additional O-ring 42 is seated within a groove 44 formed in the inner surface and approximately two inches from the top end of the tube 22.

Referring to FIG. 3, whether the condensate trap used in a draw-through or blow-through system, float 30 is at rest over thru-hole 34 when the blower is off. Any residual condensate overflowing into the trap causes the float to rise from the bottom seat to allow the condensate to drain from the trap through the thru-hole 34. The float then returns to cover the hole to maintain an air-tight seal between the air conditioning system and the external atmosphere.

Figure 4A:
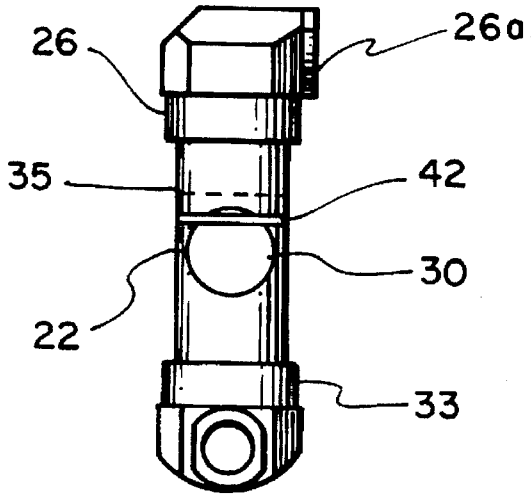
FIGS. 4A–4B are side views showing the condensate trap of FIG. 3 in use with a "draw-through" system and a "blow-through" system, respectively.

Referring to FIG. 4A, in a draw-through system, when the blower is activated, a negative pressure within the tube relative to the external atmosphere exists which causes float 30 to rise until it contacts and forms an air-tight seal against O-ring 42. Condensate 35 draining into the chamber from the condensate pan accumulates on top of the float until the weight of the condensate overcomes the negative pressure exerted on the float; thus, allowing the condensate to drain around the float and to outlet port 28*a* of the trap. With the weight of the condensate removed, float 30 is pulled back into position against O-ring 42 by the negative pressure. Note that when using the condensate trap in a draw-through system, the discharge piping must be vented to atmosphere at a position near the outlet port.

Figure 4B:
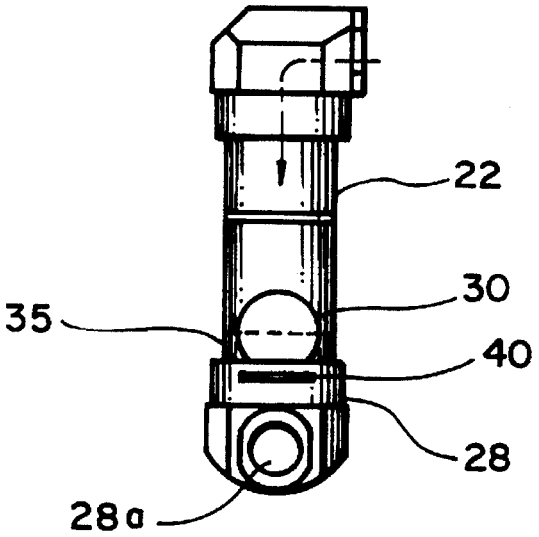

Referring to FIG. 4B, in a blow-through system, when the blower is activated, a positive pressure exists within the tube relative to the external atmosphere. The positive pressure pushes float 30 against bottom seat surface 33. When a sufficient amount of condensate 35 drains into tube 22, the buoyancy of the float causes it to overcome the positive pressure generated by the blower and rise sufficiently to allow the condensate to drain to outlet port 28*a*. With the condensate drained from the trap, float 30 is pushed back into position against O-ring 40.

Thus, isolation between the air conditioning system and external atmosphere is maintained at all times whether the condensate trap is used with a drain-through or blow-through systems.

Figure 5:
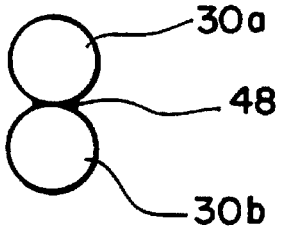
FIG. 5 is a perspective view of an alternate float.

Referring to FIG. 5, in a blow-through system, it is generally preferable that the float be formed as a pair of round hollow balls 30*a*, 30*b* attached with adhesive 48. The pair of balls increases the buoyancy of the float to allow it to more easily overcome the positive pressure generated by the blower. Other approaches for increasing the buoyancy of the float may be used as well. For example, the float may be fabricated from lighter material or with a different shape.

Other embodiments are within the scope of the claims. For example, the float, chamber, seals and ports can be any of a variety of materials and shapes.

What is claimed is:

1. A condensate trap for an air conditioning system comprising:

a chamber having an upstream port for coupling to the air conditioning system and a downstream port open to external atmosphere;

a sealing device disposed in the chamber;

a lower seat member positioned in the chamber, the sealing device, contacting the seat member to prevent air from the air conditioning system from exiting to the external atmosphere; and an upper seat member, disposed in the chamber between the sealing device and the upstream port, the sealing device, in response to a negative pressure at the upstream port, contacting the upper seat member and forming a seal which prevents ingress of air from the external atmosphere into the air conditioning system.

2. The condensate trap of claim 1 wherein, in response to a predetermined amount of condensation fluid accumulating in the chamber, the sealing device moves out of contact with one of the seat members to allow the fluid to drain from the downstream port of the chamber.

3. The condensate trap of claim 1 wherein the sealing device is a float.

4. The condensate trap of claim 3 wherein the float is a hollow round ball.

5. The condensate trap of claim 1 wherein the chamber comprises a cylindrical tube.

6. The condensate trap of claim 5 wherein the cylindrical tube is formed of a transparent material.

7. The condensate trap of claim 5 wherein the upper seat member comprises an O-ring.

8. The condensate trap of claim 7 wherein an inner surface of the tube includes a groove within which the O-ring is disposed.

9. The condensate trap of claim 3 wherein the lower seat member has an upper concave surface which contacts the ball.

10. The condensate trap of claim 9 wherein the lower seat member further includes an O-ring.

11. A condensate trap for an air conditioning system comprising:

a chamber having an upstream port for coupling to the air conditioning system and a downstream port open to external atmosphere;

a sealing device disposed in the chamber;

a lower seat member positioned in the chamber, the sealing device, contacting the seat member to prevent air from the air conditioning system from exiting to the external atmosphere; and an upper seat member, disposed in the chamber between the sealing device and the upstream port, the sealing device, wherein in response to a positive pressure at the upstream port, the sealing device contacts the lower seat member to form a seal to prevent air from the air conditioning system from exiting to the external atmosphere and, in response, to a negative pressure at the upstream port, the sealing device contacts the upper seat member to form a seal to prevent the ingress of air from the external atmosphere into the air conditioning system.

* * * * *